US011663963B1

(12) United States Patent
Hsu et al.

(10) Patent No.: US 11,663,963 B1
(45) Date of Patent: May 30, 2023

(54) PIXEL CIRCUIT

(71) Applicant: AUO Corporation, Hsinchu (TW)

(72) Inventors: Ya-Ling Hsu, Hsinchu (TW); Peng-Bo Xi, Hsinchu (TW)

(73) Assignee: AUO Corporation, Hsinchu (TW)

( * ) Notice: Subject to any disclaimer, the term of this patent is extended or adjusted under 35 U.S.C. 154(b) by 0 days.

(21) Appl. No.: 17/880,629

(22) Filed: Aug. 3, 2022

(30) Foreign Application Priority Data

Feb. 22, 2022 (TW) ..... 11110639.6

(51) Int. Cl.
*G09G 3/32* (2016.01)

(52) U.S. Cl.
CPC ..... *G09G 3/32* (2013.01); *G09G 2300/0852* (2013.01); *G09G 2310/061* (2013.01)

(58) Field of Classification Search
CPC ..... G09G 3/32; G09G 2300/0852; G09G 2310/061; G09G 2320/0633; G09G 2320/064; G09G 3/3283; G09G 2300/0819; G09G 2300/0842; G09G 2300/0861; G09G 3/3233; G09G 3/3225; G09G 3/3208; G09G 3/3291
See application file for complete search history.

(56) References Cited

U.S. PATENT DOCUMENTS

| | | | | |
|---|---|---|---|---|
| 9,262,966 | B2 | 2/2016 | Qi et al. | |
| 10,984,707 | B2 * | 4/2021 | Lee | G09G 3/32 |
| 2004/0012336 | A1 * | 1/2004 | Okuda | G09G 3/3216 315/169.1 |
| 2015/0206476 | A1 | 7/2015 | Qi et al. | |
| 2020/0403131 | A1 * | 12/2020 | Kim | H01L 25/0753 |

FOREIGN PATENT DOCUMENTS

| | | |
|---|---|---|
| CN | 103383834 | 11/2013 |
| CN | 103795265 | 5/2014 |

* cited by examiner

*Primary Examiner* — Lunyi Lao
*Assistant Examiner* — Jarurat Suteerawongsa
(74) *Attorney, Agent, or Firm* — JCIPRNET

(57) ABSTRACT

A pixel circuit includes a light emitting element, a first local light emitting switch, a second local light emitting switch, a common light emitting switch, and a driving block. The light emitting element has a first light emitting part and a second light emitting part. The first local light emitting switch is coupled between a first power terminal and the driving block. The second local light emitting switch is coupled between a second power terminal and the driving block. The common light emitting switch is coupled between the driving block and the light emitting element. The driving block provides a first driving current and a second driving current to the first light emitting part and the second light emitting part respectively based on a first frame gate signal and a second frame gate signal; a direction of the first driving current is different from that of the second driving current.

15 Claims, 6 Drawing Sheets

PIXEL CIRCUIT

CROSS-REFERENCE TO RELATED APPLICATION

This application claims the priority benefit of Taiwan application serial no. 111106396, filed on Feb. 22, 2022. The entirety of the above-mentioned patent application is hereby incorporated by reference herein and made a part of this specification.

BACKGROUND

Technical Field

The disclosure relates to a pixel circuit; more particularly, the disclosure relates to a self-illuminating pixel circuit.

Description of Related Art

In recent years, due to the advantages of low power consumption, the reduced thickness of the display panel, bright colors, evident contrast, and the performance against motion blur, self-illuminating display technologies have become the mainstream choice of technology in display devices.

With the progress of the semiconductor manufacturing process, different light emitting elements are applied to the screen display, and the display panel is correspondingly equipped with different driving circuits. As to a light emitting element with both forward and reverse driving characteristics, a correspondingly designed driving circuit is required to constitute a self-illuminating pixel circuit.

SUMMARY

The disclosure provides a pixel circuit to which a light emitting element with forward and reverse driving characteristics is applied, so as to provide a novel driving circuit.

In an embodiment of the disclosure, a pixel circuit including a light emitting element, a first local light emitting switch, a second local light emitting switch, a common light emitting switch, and a driving block is provided. The light emitting element has one terminal coupled to a common terminal and has a first light emitting part and a second light emitting part, where a direction of a first driving current driving the first light emitting part is opposite to a direction of a second driving current driving the second light emitting part. The first local light emitting switch has a first terminal coupled to a first power terminal, a control terminal receiving a first frame light emitting signal, and a second terminal. The second local light emitting switch has a first terminal coupled to a second power terminal, a control terminal receiving a second frame light emitting signal, and a second terminal. A common light emitting switch has a first terminal, a control terminal receiving a common light emitting signal, and a second terminal coupled to the other terminal of the light emitting element. The driving block receives a data signal, a first frame gate signal, and a second frame gate signal and is coupled to the second terminal of the first local light emitting switch, the second terminal of the second local light emitting switch, and the first terminal of the common light emitting switch. The driving block generates one of a first current path and a second current path based on the first frame gate signal and the second frame gate signal, where the first current path is generated between the second terminal of the first local light emitting switch and the first terminal of the common light emitting switch, the first driving current is transmitted through the first current path; the second current path is generated between the second terminal of the second local light emitting switch and the first terminal of the common light emitting switch, and the second driving current is transmitted through the second current path. The data signal sets a current amplitude of the first driving current and the second driving current.

In view of the above, the pixel circuit provided in one or more embodiments of the disclosure may, by means of the well-designed driving block, provide the first driving current and the second driving current that flow in different direction and are required by the light emitting element with the bi-directional driving capability, so that the pixel circuit is applicable to the novel light emitting element and may operate smoothly.

To make the above more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles provided in the disclosure.

DESCRIPTION OF THE EMBODIMENTS

Unless otherwise defined, all terminologies (including technical and scientific terminologies) used herein have the same meanings commonly understood by those having ordinary skill in the art. It is understandable that these terminologies, such as those defined in commonly used dictionaries, should be interpreted as having a meaning consistent with the relevant technology and the background or context of this disclosure, rather than being interpreted in an idealized or overly formal way, unless specifically defined here.

It should be understood that terminologies such as "first", "second", "third", etc. may serve to describe various elements, components, regions, layers, and/or parts, but these elements, components, regions, layers, and/or parts should not be limited by these terminologies. The terminologies are only intended to distinguish one element, component, region, layer, and/or part from another element, component, region, layer, and/or part in the specification. Accordingly, a first "element", "component", "region", "layer", and/or "part" may be referred to as a second "element", "component", "region", "layer", and/or "part" without departing from the scope of protection provided herein.

The terminologies used herein merely serve to describe particular embodiments and should not be construed as limitations. As provided herein, the singular forms "a", "an", and "the" are intended to include the plural forms including "at least one" unless the content clearly indicates otherwise, and "or" means "and/or". As provided herein, the terminologies "and/or" includes any and all combinations of one or more of the associated listed items. It should also be understood that the terminologies "comprising" and/or "including" indicate the presence of the stated feature, region, integer, step, operation, element and/or part but do not exclude one or more additional features, regions, integers, steps, elements, parts, and/or combinations thereof.

Figure 1:
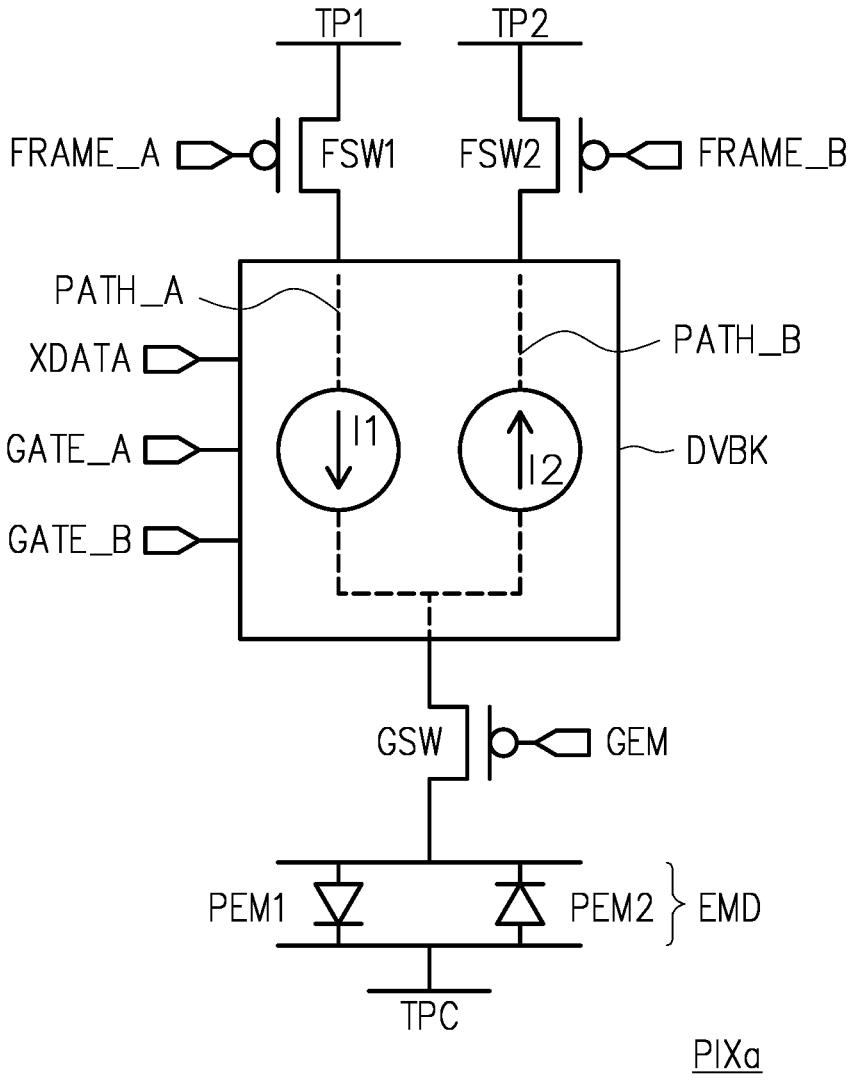
FIG. 1 is a schematic view illustrating a system of a pixel circuit according to an embodiment of the disclosure.

FIG. 1 is a schematic view illustrating a system of a pixel circuit according to an embodiment of the disclosure. With reference to FIG. 1, in this embodiment, a pixel circuit PIXa includes a light emitting element EMD, a first local light emitting switch FSW1, a second local light emitting switch FSW2, a common light emitting switch GSW, and a driving block DVBK.

The light emitting element EMD has one terminal coupled to a common terminal and has a first light emitting part PEM1 and a second light emitting part PEM2. Here, the light emitting element EMD is a nanorod light emitting element, which should however not be construed as a limitation in the disclosure. The first local light emitting switch FSW1 has a first terminal coupled to a first power terminal TP1, a control terminal receiving a first frame light emitting signal FRAME_A, and a second terminal. The second local light emitting switch FSW2 has a first terminal coupled to a second power terminal TP2, a control terminal receiving a second frame light emitting signal FRAME_B, and a second terminal.

The common light emitting switch GSW has a first terminal, a control terminal receiving a common light emitting signal GEM, and a second terminal coupled to the other terminal of the light emitting element EMD. The driving block DVBK receives a data signal XDATA, a first frame gate signal GATE_A, and a second frame gate signal GATE_B and is coupled to the second terminal of the first local light emitting switch FSW1, the second terminal of the second local light emitting switch FSW2, and the first terminal of the common light emitting switch GSW. The driving block DVBK generates one of a first current path PATH_A and a second current path PATH_B based on the first frame gate signal GATE_A and the second frame gate signal GATE_B, the first current path PATH_A is generated between the second terminal of the first local light emitting switch FSW1 and the first terminal of the common light emitting switch GSW, and a first driving current I1 is transmitted through the first current path PATH_A; the second current path PATH_B is generated between the second terminal of the second local light emitting switch FSW2 and the first terminal of the common light emitting switch GSW, and a second driving current I2 is transmitted through the second current path PATH_B.

In this embodiment, the first driving current I1 serves to drive the first light emitting part PEM1, and the second driving current I2 serves to drive the second light emitting part PEM2, wherein a direction of the first driving current I1 is opposite to a direction of the second driving current I2. That is, the first light emitting part PEM1 may be considered as being driven in a forward manner, and the second light emitting part PEM2 may be considered as being driven in a reverse manner. The data signal XDATA sets a current amplitude of the first driving current I2 and the second driving current I2, so as to determine light emitting brightness of the first light emitting part PEM1 and the second light emitting part. By means of the well-designed driving block, the forward current (e.g., the first driving current I1) required by the light emitting element driven in a forward manner and the reverse current (e.g., the second driving current I2) required by the light emitting element driven in a reverse manner may be provided, so that the pixel circuit may operate smoothly.

In this embodiment, the first local light emitting switch FSW1, the second local light emitting switch FSW2, and the common light emitting switch GSW are all p-type transistors, for instance, which should however not be construed as a limitation in the disclosure.

In this embodiment, a voltage of the first power terminal TP1 is different from a voltage of the second power terminal TP2. For instance, the voltage of the first power terminal TP1 may be greater than the voltage of the second power terminal TP2, and a voltage of the common terminal TPC ranges from the voltage of the first power terminal TP1 and the voltage of the second power termina TP2. Hence, the first driving current I1 transmitted through the first current path PATH_A is a forward current, and the second driving current I2 transmitted through the second current path PATH_B is a reverse circuit.

Figure 2:
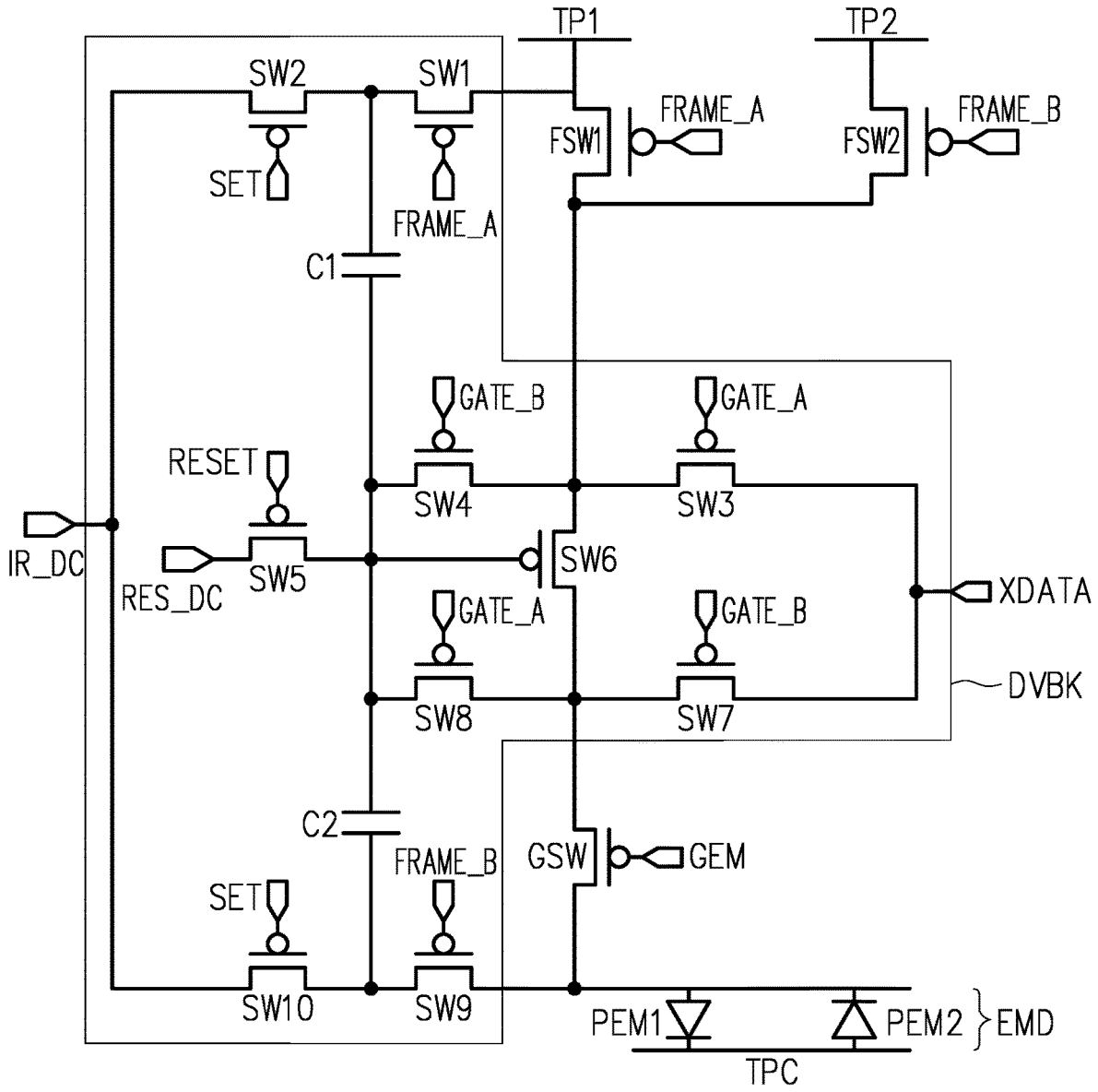
FIG. 2 is a schematic circuitry view illustrating a pixel circuit according to an embodiment of the disclosure.

FIG. 2 is a schematic circuitry view illustrating a pixel circuit according to an embodiment of the disclosure. FIG. 2 is a schematic circuit view illustrating a pixel circuit according to an embodiment of the disclosure. With reference to FIG. 1 and FIG. 2, the same or similar elements are marked by the same or similar reference numbers. In this embodiment, the driving block DVBK includes a first switch SW1, a second switch SW2, a third switch SW3, a fourth switch SW4, a fifth switch SW5, a sixth switch SW6, a seventh switch SW7, an eighth switch SW8, a ninth switch SW9, a tenth switch SW10, a first capacitor C1, and a second capacitor C2.

The first switch SW1 has a first terminal coupled to the first power terminal TP1, a control terminal that receives the first frame light emitting signal FRAME_A, and a second terminal. The second switch SW2 has a first terminal coupled to the second terminal of the first switch SW1, a control terminal that receives a set signal SET, and a second terminal that receives a first direct current level IR_DC. The third switch SW3 has a first terminal that receives the data signal XDATA, a control terminal that receives the first frame gate signal GATE_A, and a second terminal that is coupled to the second terminal of the first local light emitting switch FSW1.

The fourth switch SW4 has a first terminal coupled to the second terminal of the first local light emitting switch FSW1, a control terminal that receives the second frame gate signal GATE_B, and a second terminal. The first capacitor C1 is coupled between the second terminal of the first switch SW1 and the second terminal of the fourth switch SW4. The fifth switch SW5 has a first terminal coupled to the second terminal of the fourth switch SW4, a control terminal that receives a reset signal RESET, and a second terminal that receives a second direct current level RES_DC.

The sixth switch SW6 has a first terminal coupled to the second terminal of the first local light emitting switch FSW1, a control terminal coupled to the second terminal of the fourth switch SW4, and a second terminal. The seventh switch SW7 has a first terminal that receives the data signal XDATA, a control terminal that receives the second frame gate signal GATE_B, and a second terminal coupled to the second terminal of the sixth switch SW6. The eighth switch SW8 has a first terminal coupled to the second terminal of the seventh switch SW7, a control terminal that receives the first frame gate signal GATE_A, and a second terminal coupled to the second terminal of the fourth switch SW4.

The ninth switch SW9 has a first terminal coupled to the other terminal of the light emitting element EMD, a control terminal receiving the second frame light emitting signal FRAME_B, and a second terminal. The second capacitor C2 is coupled between the second terminal of the eighth switch SW8 and the second terminal of the ninth switch SW9. The tenth switch SW10 has a first terminal coupled to the second terminal of the ninth switch SW9, a control terminal that receives the set signal SET, and a second terminal that receives the first direct current level IR_DC.

In this embodiment, the first switch SW1 to the tenth switch SW10 are all p-type transistors, for instance, which should however not be construed as a limitation in the disclosure. Besides, the second direct current level RES_DC may be different from the first direct current level IR_DC.

Figure 3:
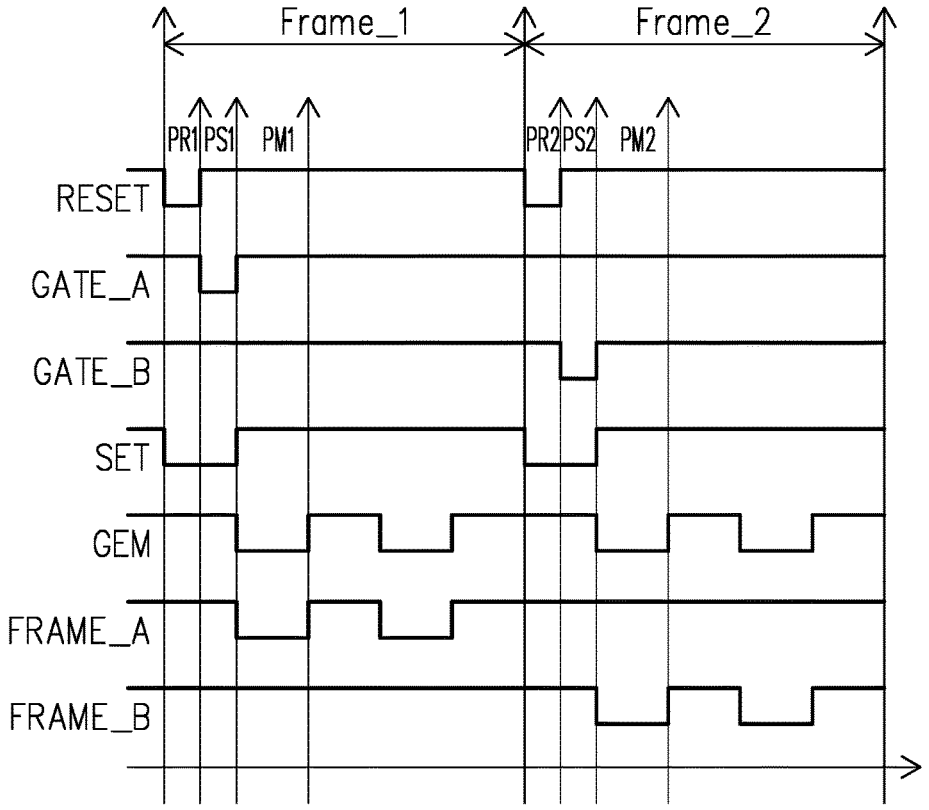
FIG. 3 is a schematic view illustrating an operating timing of a pixel circuit according to an embodiment of the disclosure.

FIG. 3 is a schematic view illustrating an operating timing of a pixel circuit according to an embodiment of the disclosure. With reference to FIG. 2 and FIG. 3, in this embodiment, a first frame period Frame_1 and a second frame period Frame_2 are illustrated as an example, and the second frame period Frame_2 is shown as the next frame period of the first frame period Frame_1; that is, there is no time interval between the second frame period Frame_2 and the first frame period Frame_1. However, the disclosure embodiment is not so limited.

In this embodiment, the first frame light emitting signal FRAME_A is enabled in a plurality of first light emitting periods PM1 of the first frame period Frame_1, the second frame light emitting signal FRAME_B is enabled in a plurality of second light emitting periods PM2 of the second frame period Frame_2, and the common light emitting signal GEM is enabled in the first light emitting periods PM1 of the first frame period Frame_1 and the second light emitting periods PM2 of the second frame period Frame_2.

The reset signal RESET is enabled in a first reset period PR1 of the first frame period Frame_1 and a second reset period PR2 of the second frame period Frame_2, the first frame gate signal GATE_A is enabled in a first set period PS1 of the first frame period Frame_1, the second frame gate signal GATE_B is enabled in a second set period PS2 of the second frame period Frame_2, and the set signal SET is enabled in the first reset period PR1 and the first set period PS1 of the first frame period Frame_1 and the second reset period PR2 and the second set period PS2 of the second frame period Frame_2.

In this embodiment, the first set period PS1 follows the first reset period PR1, and the second set period PS2 follows the second reset period PR2. The first light emitting periods PM1 are cyclically arranged in the first frame period Frame_1, and the second light emitting periods PM2 are cyclically arranged in the second frame period Frame_2. The first set period PS1 and the first reset period PR1 do not overlap the first light emitting periods PM1, and the second set period PS2 and the second reset period PR2 do not overlap the second light emitting periods PM2.

Figure 4A:
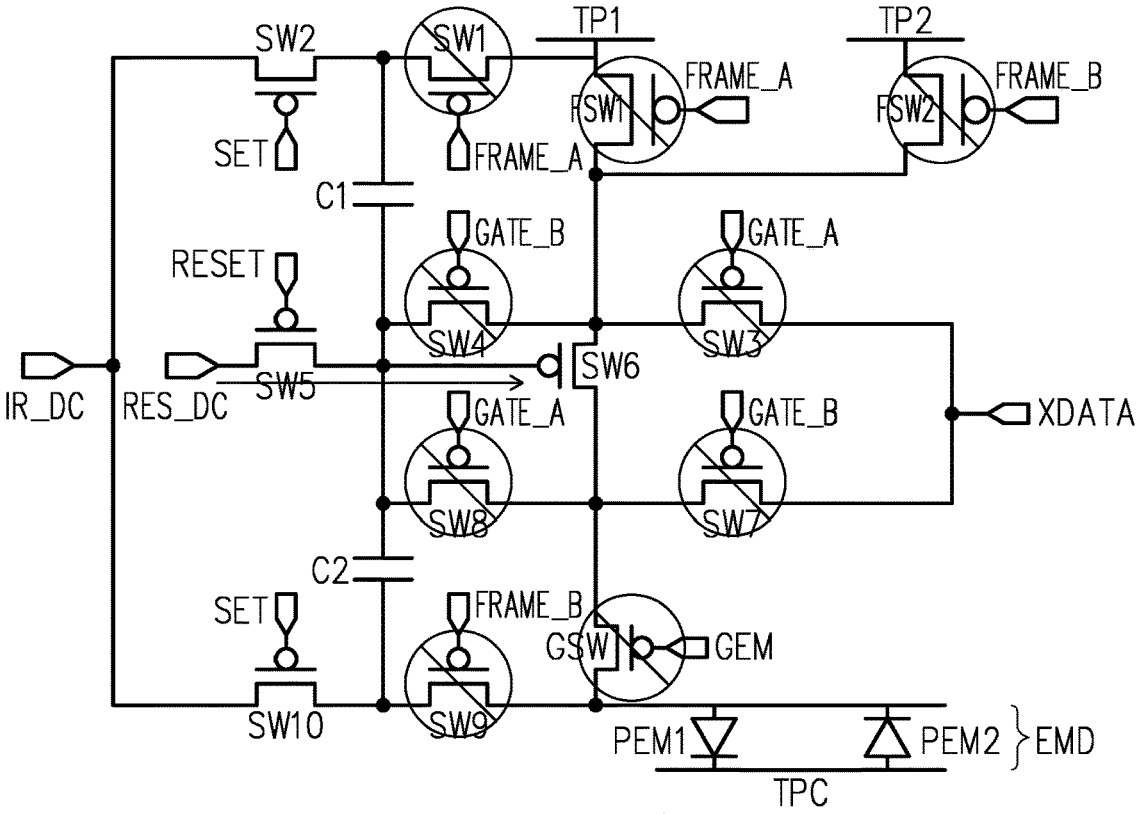
FIG. 4A is a schematic view illustrating an operation of a pixel circuit in a first reset period and a second reset period according to an embodiment of the disclosure.

FIG. 4A is a schematic view illustrating an operation of a pixel circuit in a first reset period and a second reset period according to an embodiment of the disclosure. With reference to FIG. 2, FIG. 3, and FIG. 4A, in the first reset period PR1 of the first frame period Frame_1 and the second reset period PR2 of the second frame period Frame_2, the reset signal RESET and the set signal SET are enabled, and the first frame gate signal GATE_A, the second frame gate signal GATE_B, the common light emitting signal GEM, the first frame light emitting signal FRAME_A, and the second frame light emitting signal FRAME_B are disabled.

At this time, the second switch SW2, the fifth switch SW5, and the tenth switch SW10 are turned on, and the first local light emitting switch FSW1, the second local light emitting switch FSW2, the common light emitting switch GSW, the first switch SW1, the third switch SW3, the fourth switch SW4, the sixth switch SW6, the seventh switch SW7, the eighth switch SW8, and the ninth switch SW9 are turned off. Therefore, the first capacitor C1 and the second capacitor C2 store the voltage difference between the first direct current level IR_DC and the second direct current level RES_DC. Here, the voltage difference between the first direct current level IR_DC and the second direct current level RES_DC may serve to compensate a threshold voltage of the transistor or adjust the displayed brightness, which should however not be construed as a limitation in the disclosure.

Figure 4B:
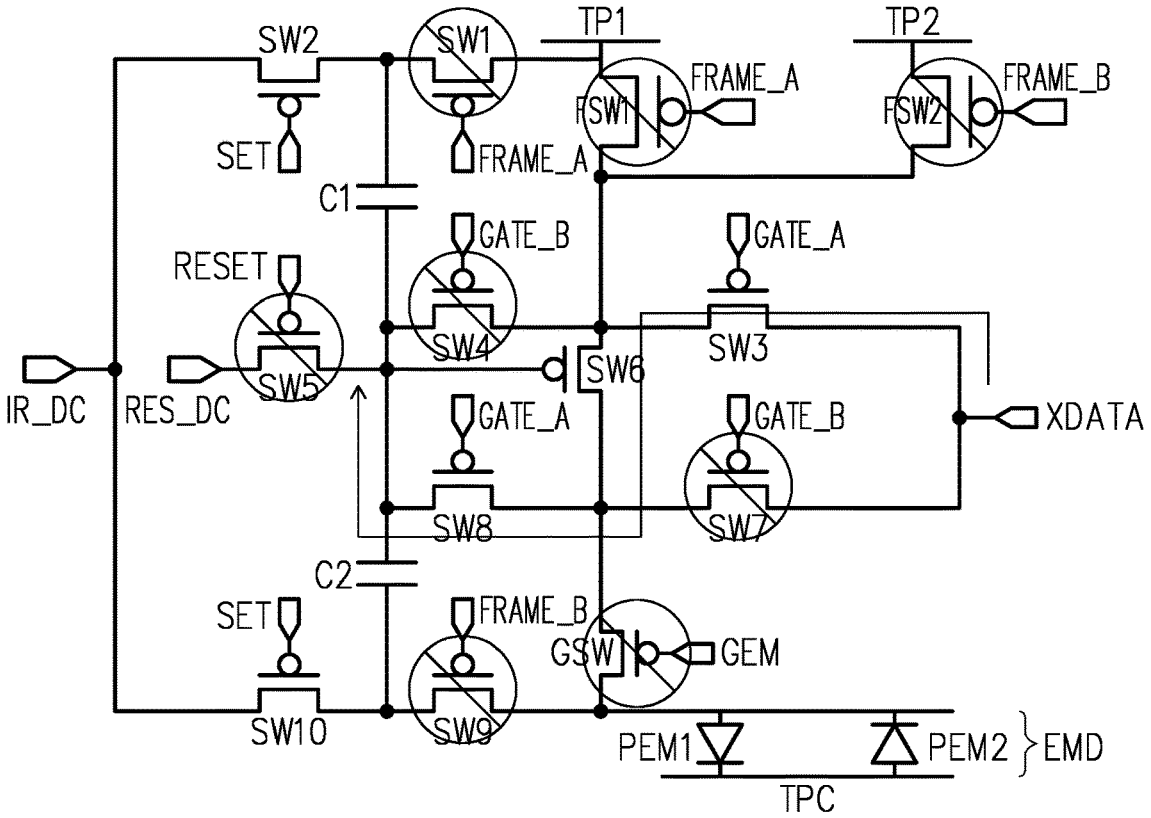
FIG. 4B is a schematic view illustrating an operation of a pixel circuit in a first set period and a second set period according to an embodiment of the disclosure.

FIG. 4B is a schematic view illustrating an operation of a pixel circuit in a first set period and a second set period according to an embodiment of the disclosure. With reference to FIG. 2, FIG. 3, and FIG. 4B, in the first set period PS1 of the first frame period Frame_1, the set signal SET and the first frame gate signal GATE_A are enabled, and the reset signal RESET, the second frame gate signal GATE_B, the common light emitting signal GEM, the first frame light emitting signal FRAME_A, and the second frame light emitting signal FRAME_B are disabled.

At this time, the second switch SW2, the third switch SW3, the sixth switch SW6, the eighth switch SW8, and the tenth switch SW10 are turned on, and the first local light emitting switch FSW1, the second local light emitting switch FSW2, the common light emitting switch GSW, the first switch SW1, the fourth switch SW4, the fifth switch SW5, the seventh switch SW7, and the ninth switch SW9 are turned off. Therefore, the first capacitor C1 and the second capacitor C2 store the sum of the voltage difference between the first direct current level IR_DC and the second direct current level RES_DC and the voltage level of the data signal XDATA.

Figure 4C:
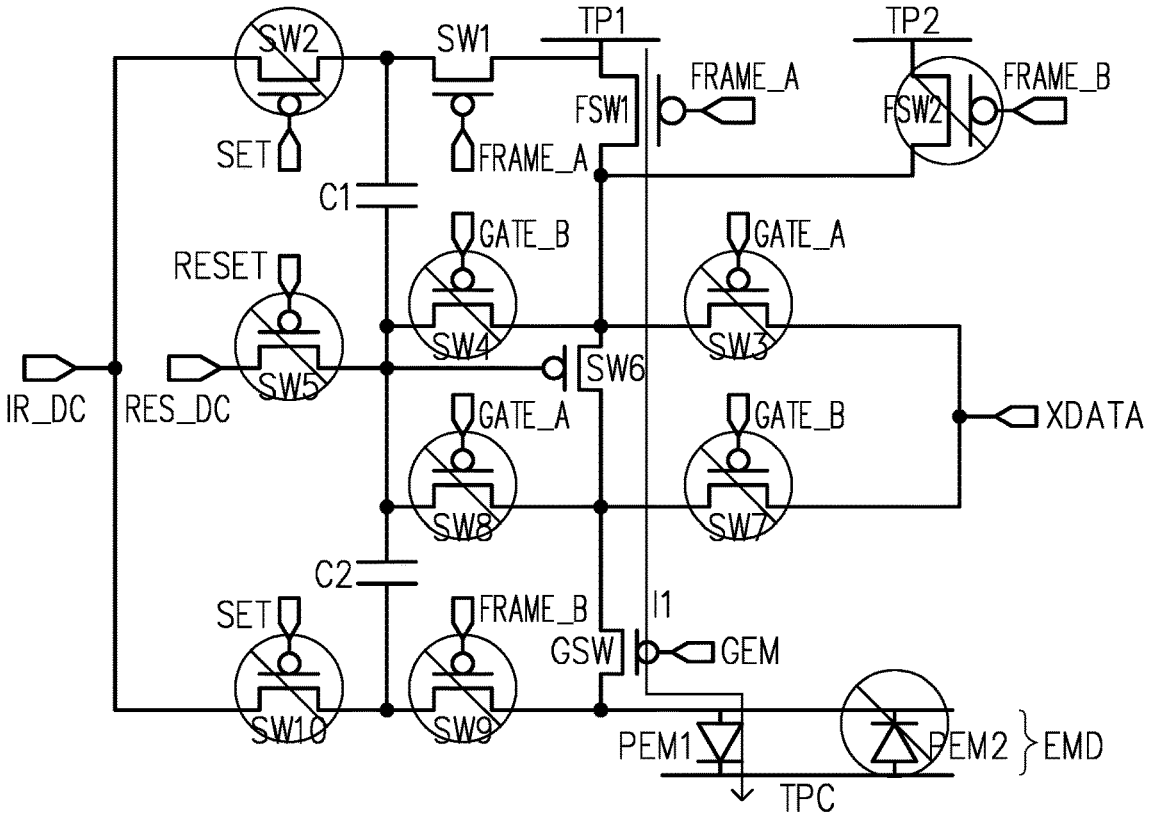
FIG. 4C is a schematic view illustrating an operation of a pixel circuit in a first light emitting period according to an embodiment of the disclosure.

FIG. 4C is a schematic view illustrating an operation of a pixel circuit in a first light emitting period according to an embodiment of the disclosure. With reference to FIG. 2, FIG. 3, and FIG. 4C, in the first light emitting periods PM1 of the first frame period Frame_1, the common light emitting signal GEM and the first frame light emitting signal FRAME_A are enabled, and the set signal SET, the reset signal RESET, the first frame gate signal GATE_A, the second frame gate signal GATE_B, and the second frame light emitting signal FRAME_B are disabled.

At this time, the first local light emitting switch FSW1, the common light emitting switch GSW, the first switch SW1, and the sixth switch SW6 are turned on, and the second local light emitting switch FSW2, the second switch SW2, the third switch SW3, the fourth switch SW4, the fifth switch SW5, the seventh switch SW7, the eighth switch SW8, the ninth switch SW9, and the tenth switch SW10 are turned off. Besides, the first driving current I1 is transmitted to the first light emitting part PEM1 through the first local light emitting switch FSW1, the sixth switch SW6, and the common light emitting switch GSW that are turned on. Since the degree of conduction of the sixth switch SW6 is associated with the voltage stored by the first capacitor C1, the current amplitude of the first driving current I1 is associated with the data signal XDATA.

Figure 4D:
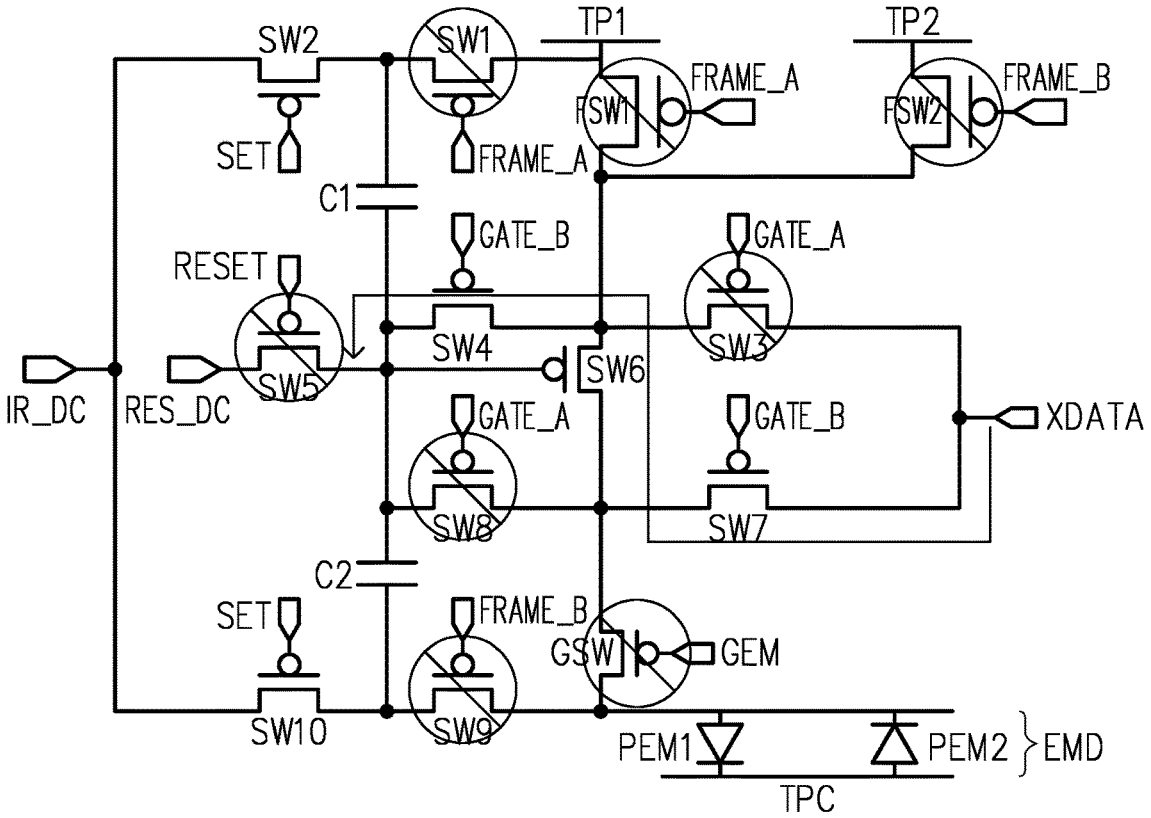
FIG. 4D is a schematic view illustrating an operation of a pixel circuit in a second set period according to an embodiment of the disclosure.

FIG. 4D is a schematic view illustrating an operation of a pixel circuit in a second set period according to an embodiment of the disclosure. With reference to FIG. 2, FIG. 3, and FIG. 4D, in the second set period PS2 of the second frame period Frame_2, the set signal SET and the second frame gate signal GATE_B are enabled, and the reset signal RESET, the first frame gate signal GATE_A, the common light emitting signal GEM, the first frame light emitting signal FRAME_A, and the second frame light emitting signal FRAME_B are disabled.

At this time, the second switch SW2, the fourth switch SW4, the sixth switch SW6, the seventh switch SW7, and the tenth switch SW10 are turned on, and the first local light emitting switch FSW1, the second local light emitting switch FSW2, the common light emitting switch GSW, the first switch SW1, the third switch SW3, the fifth switch SW5, the eighth switch SW8, and the ninth switch SW9 are turned off. Therefore, the first capacitor C1 and the second capacitor C2 still store the sum of the voltage difference between the first direct current level IR_DC and the second direct current level RES_DC and the voltage level of the data signal XDATA.

Figure 4E:
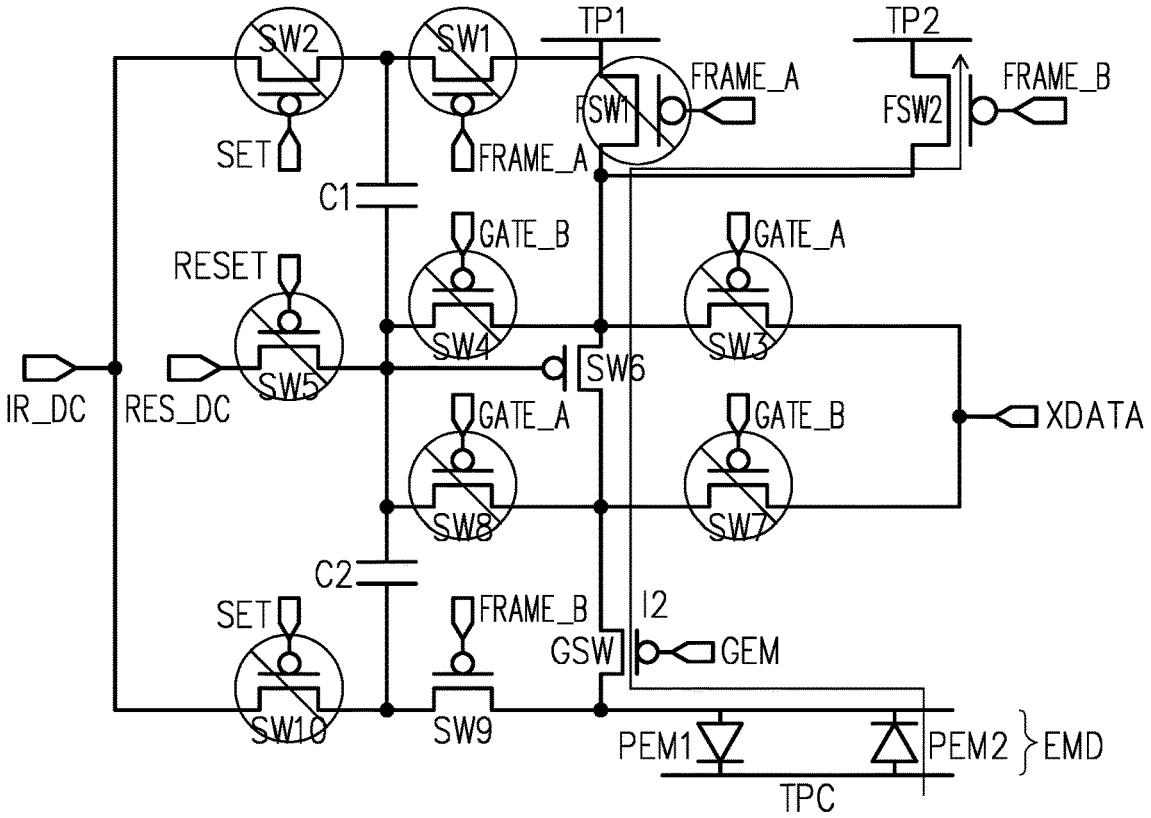
FIG. 4E is a schematic view illustrating an operation of a pixel circuit in a second light emitting period according to an embodiment of the disclosure.

FIG. 4E is a schematic view illustrating an operation of a pixel circuit in a second light emitting period according to an embodiment of the disclosure. With reference to FIG. 2, FIG. 3, and FIG. 4E, in the second light emitting periods PM2 of the first frame period Frame_2, the common light emitting signal GEM and the second frame light emitting signal FRAME_B are enabled, and the set signal SET, the reset signal RESET, the first frame gate signal GATE_A, the second frame gate signal GATE_B, and the first frame light emitting signal FRAME_A are disabled.

At this time, the first local light emitting switch FSW1, the common light emitting switch GSW, the sixth switch SW6, and the ninth switch SW9 are turned on, and the second local light emitting switch FSW2, the first switch SW1, the second switch SW2, the third switch SW3, the fourth switch SW4, the fifth switch SW5, the seventh switch SW7, the eighth switch SW8, and the tenth switch SW10 are turned off. Besides, the second driving current I2 is received from the second light emitting part PEM1 through the second local light emitting switch FSW2, the sixth switch SW6, and the common light emitting switch GSW that are turned on. Since the degree of conduction of the sixth switch SW6 is associated with the voltage stored by the second capacitor C2, the current amplitude of the second driving current I2 is associated with the data signal XDATA.

Figure 5:
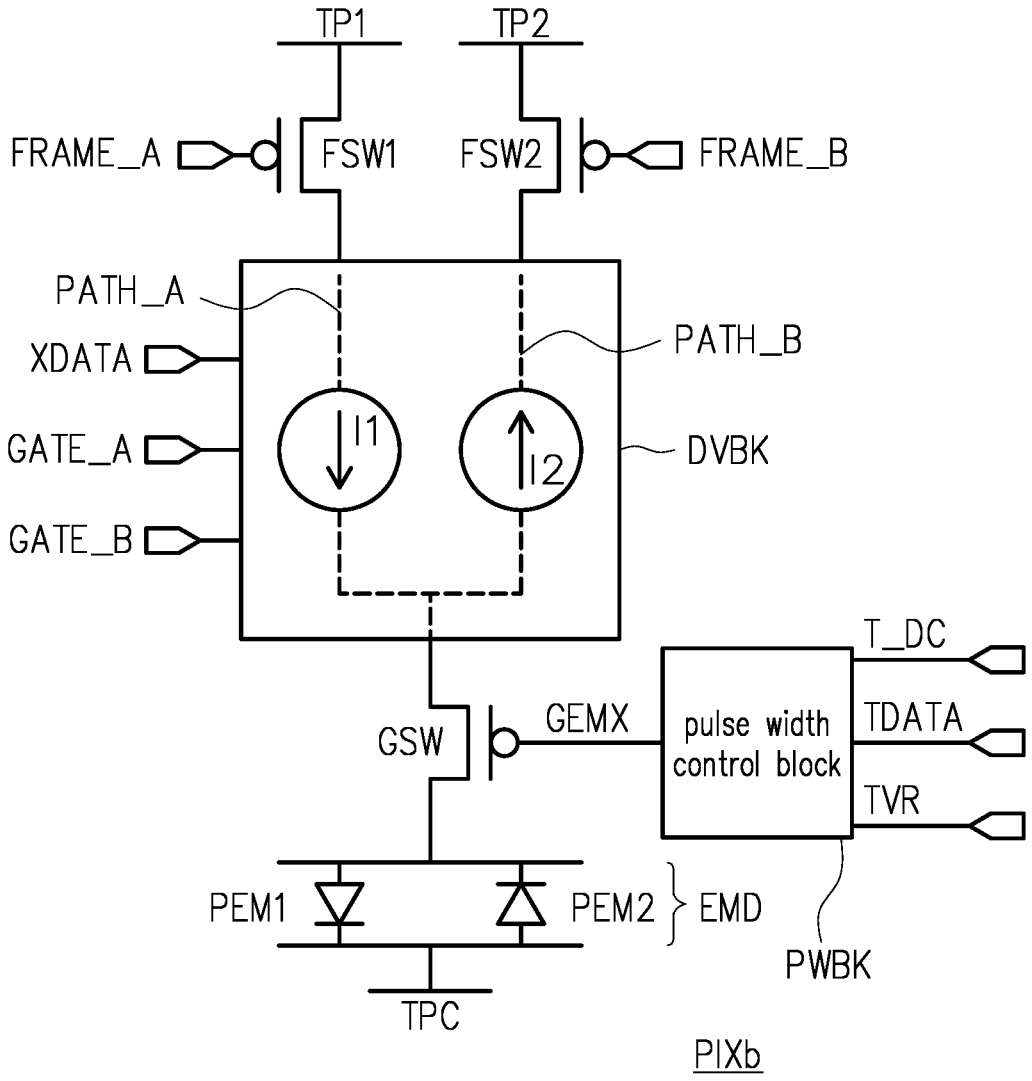
FIG. 5 is a schematic view illustrating a system of a pixel circuit according to another embodiment of the disclosure.

FIG. 5 is a schematic view illustrating a system of a pixel circuit according to another embodiment of the disclosure. With reference to FIG. 1 and FIG. 5, a pixel circuit PIXb is substantially the same as the pixel circuit PIXa, while the difference therebetween lies in that the pixel circuit PIXb further includes a pulse width control block PWBK, where the same or similar elements are marked by the same or similar reference numbers. In this embodiment, the pulse width control block PWBK is coupled to the control terminal of the common light emitting switch GSW and receives a time reference direct current level T_DC, a time voltage slope reference signal TVR, and a time data signal TDATA, so as to provide a common light emitting signal GEMX in replacement of the common light emitting signal GEM. Here, the common light emitting signal GEMX is adjusted based on the time data signal TDATA.

To sum up, the pixel circuit provided in one or more embodiments of the disclosure may, by means of the well-designed driving block, provide the first driving current and the second driving current that flow in different directions and are required by the light emitting element with the bi-directional driving capability, so that the pixel circuit may be applied to the novel light emitting element and may operate smoothly.

It will be apparent to those skilled in the art that various modifications and variations may be made to the disclosed embodiments without departing from the scope or spirit of the disclosure. In view of the foregoing, it is intended that the disclosure covers modifications and variations provided they fall within the scope of the following claims and their equivalents.

What is claimed is:

1. A pixel circuit, comprising:

a light emitting element, having one terminal coupled to a common terminal and having a first light emitting part and a second light emitting part, wherein a direction of a first driving current driving the first light emitting part is opposite to a direction of a second driving current driving the second light emitting part;

a first local light emitting switch, having a first terminal coupled to a first power terminal, a control terminal receiving a first frame light emitting signal, and a second terminal;

a second local light emitting switch, having a first terminal coupled to a second power terminal, a control terminal receiving a second frame light emitting signal, and a second terminal;

a common light emitting switch, having a first terminal, a control terminal receiving a common light emitting signal, and a second terminal coupled to the other terminal of the light emitting element; and a driving block, receiving a data signal, a first frame gate signal, and a second frame gate signal and coupled to the second terminal of the first local light emitting switch, the second terminal of the second local light emitting switch, and the first terminal of the common light emitting switch, wherein the driving block generates one of a first current path and a second current path based on the first frame gate signal and the second frame gate signal, the first current path is generated between the second terminal of the first local light emitting switch and the first terminal of the common light emitting switch, the first driving current is transmitted through the first current path, the second current path is generated between the second terminal of the second local light emitting switch and the first terminal of the common light emitting switch, and the second driving current is transmitted through the second current path, wherein the data signal sets a current amplitude of the first driving current and the second driving current.

2. The pixel circuit according to claim 1, wherein the driving block comprises:

a first switch, having a first terminal coupled to the first power terminal, a control terminal receiving the first frame light emitting signal, and a second terminal;

a second switch, having a first terminal coupled to the second terminal of the first switch, a control terminal receiving a set signal, and a second terminal receiving a first direct current level;

a third switch, having a first terminal receiving the data signal, a control terminal receiving the first frame gate signal, and a second terminal coupled to the second terminal of the first local light emitting switch;

a fourth switch, having a first terminal coupled to the second terminal of the first local light emitting switch, a control terminal receiving the second frame gate signal, and a second terminal;

a first capacitor, coupled to the second terminal of the first switch and the second terminal of the fourth switch;

a fifth switch, having a first terminal coupled to the second terminal of the fourth switch, a control terminal receiving a reset signal, and a second terminal receiving a second direct current level;

a sixth switch, having a first terminal coupled to the second terminal of the first local light emitting switch, a control terminal coupled to the second terminal of the fourth switch, and a second terminal;

a seventh switch, having a first terminal receiving the data signal, a control terminal receiving the second frame gate signal, and a second terminal coupled to the second terminal of the sixth switch;

an eighth switch, having a first terminal coupled to the second terminal of the seventh switch, a control terminal receiving the first frame gate signal, and a second terminal coupled to the second terminal of the fourth switch;

a ninth switch, having a first terminal coupled to the other terminal of the light emitting element, a control terminal receiving the second frame light emitting signal, and a second terminal;

a second capacitor, coupled to the second terminal of the eighth switch and the second terminal of the ninth switch; and a tenth switch, having a first terminal coupled to the second terminal of the ninth switch, a control terminal receiving the set signal, and a second terminal receiving the first direct current level.

3. The pixel circuit according to claim 2, wherein the first frame light emitting signal is enabled in a plurality of first light emitting periods of a first frame period, the second frame light emitting signal is cyclically enabled in a plurality of second light emitting periods of a second frame period, the reset signal is enabled in a first reset period of the first frame period and a second reset period of the second frame period, and the set signal is enabled in the first reset period and a first set period of the first frame period and the second reset period and a second set period of the second frame period.

4. The pixel circuit according to claim 3, wherein the second frame period is a next frame period of the first frame period.

5. The pixel circuit according to claim 3, wherein the first set period follows the first reset period, and the second set period follows the second reset period.

6. The pixel circuit according to claim 5, wherein the first light emitting periods are cyclically arranged in the first frame period, and the second light emitting periods are cyclically arranged in the second frame period.

7. The pixel circuit according to claim 6, wherein the first set period and the first reset period do not overlap the first light emitting periods, and the second set period and the second reset period do not overlap the second light emitting periods.

8. The pixel circuit according to claim 2, wherein the second direct current level is different from the first direct current level.

9. The pixel circuit according to claim 2, wherein the first switch to the tenth switch are all p-type transistors.

10. The pixel circuit according to claim 1, wherein a voltage of the first power terminal is different from a voltage of the second power terminal.

11. The pixel circuit according to claim 10, wherein the voltage of the first power terminal is greater than the voltage of the second power terminal.

12. The pixel circuit according to claim 11, wherein a voltage of the common terminal ranges from the voltage of the first power terminal and the voltage of the second power terminal.

13. The pixel circuit according to claim 1, wherein the first local light emitting switch, the second local light emitting switch, and the common light emitting switch are all p-type transistors.

14. The pixel circuit according to claim 1, wherein the light emitting element is a nanorod light emitting element.

15. The pixel circuit according to claim 1, further comprising a pulse width control region coupled to the control terminal of the common light emitting switch and receiving a time reference direct current level, a time voltage slope reference signal, and a time data signal, so as to provide the common light emitting signal, wherein a pulse width of the common light emitting signal is adjusted based on the time data signal.

* * * * *